US006236162B1

(12) United States Patent
Luz et al.

(10) Patent No.: US 6,236,162 B1
(45) Date of Patent: May 22, 2001

(54) BOOT FOR A RARE GAS ILLUMINATION SYSTEM

(75) Inventors: Barry Ray Luz, Mission Viejo, CA (US); Harry Friedman, Brookline, MA (US)

(73) Assignee: Fluis Light Technologies, Inc., Mission Viejo, CA (US)

( * ) Notice: Subject to any disclaimer, the term of this patent is extended or adjusted under 35 U.S.C. 154(b) by 0 days.

(21) Appl. No.: 09/441,266

(22) Filed: Nov. 16, 1999

(51) Int. Cl.[7] ..... H01J 13/46

(52) U.S. Cl. ..... 315/57; 362/221; 313/25; 313/576

(58) Field of Search ..... 315/326, 57, 58, 315/101, 178; 313/25, 489, 492, 573, 576, 643, 566; 362/221, 262; 340/471, 475, 479

(56) References Cited

U.S. PATENT DOCUMENTS

| | | | |
|---|---|---|---|
| Re. 21,613 | 10/1940 | Vollrath | 176/14 |
| 1,615,791 | 1/1927 | Frieman et al. . | |
| 1,879,057 | 9/1932 | Bray . | |
| 2,004,365 | 6/1935 | Bidwell | 175/183 |
| 2,018,874 | 10/1935 | Reitherman et al. | 177/327 |
| 2,026,770 | 1/1936 | Bergman | 177/352 |
| 2,265,068 | 12/1941 | Foerste | 176/124 |
| 3,019,415 | 1/1962 | Marion, Sr. | 340/82 |
| 3,183,881 | 5/1965 | Tatham, III | 116/42 |
| 3,235,768 | 2/1966 | Magunski | 315/39 |
| 3,440,448 | 4/1969 | Skivin | 315/209 |
| 3,723,784 * | 3/1973 | Sulcs et al. | 313/47 |
| 3,846,749 | 11/1974 | Curry | 340/72 |
| 3,860,507 * | 1/1975 | Vossen, Jr. | 204/192 |
| 4,127,844 | 11/1978 | Purdy | 340/71 |
| 4,231,013 | 10/1980 | Freeman et al. | 340/72 |
| 4,477,796 | 10/1984 | Kearsley | 340/105 |
| 4,550,305 | 10/1985 | Bockbinder | 340/134 |
| 4,682,146 | 7/1987 | Friedman, III | 340/77 |
| 4,818,968 | 4/1989 | Friedman, III | 315/169.1 |
| 4,835,442 * | 5/1989 | Sugimoto et al. | 313/565 |
| 5,187,415 * | 2/1993 | Osawa et al. | 313/326 |
| 5,763,964 | 6/1998 | Rotta | 307/157 |

* cited by examiner

*Primary Examiner*—Haissa Philogene
(74) *Attorney, Agent, or Firm*—Knobbee, Martens Olson & Bear, LLP

(57) ABSTRACT

A rare gas illumination system and method are configured to provide a sweeping illumination effect. In one embodiment, the rare gas illumination system includes a tube containing a gas and having a first electrode at a first end and a second electrode at a second end. A first boot having a first transformer is coupled to the first end of the tube. A second boot having a second transformer is coupled to the second end of the tube. The system includes a controller having a microcontroller, a memory, and an output power driver. The memory is configured to store a plurality of control codes corresponding to a plurality of illumination patterns. The microcontroller controls the illumination pattern of the tube by executing the corresponding control code to selectively activate the output driver to provide a voltage signal to at least one of the first boot and the second boot. The corresponding transformer steps up the provided voltage signal to excite at least one of the first electrode and the second electrode, thereby illuminating the gas within the tube.

9 Claims, 4 Drawing Sheets

BOOT FOR A RARE GAS ILLUMINATION SYSTEM

BACKGROUND OF THE INVENTION

1. Field of the Invention

The present invention relates in general to rare gas illumination, and more particularly to systems and methods for the illumination of rare gas tubes.

2. Background

Rare gas tube displays, such as neon signs, are commonly used for advertising and for artistic displays. Historically, these displays were typically illuminated by applying a high voltage signal simultaneously to electrodes at opposite ends of a sealed glass tube containing a rare gas mixture. Hence, the rare gas tubes of these displays were typically either completely "on" or completely "off."

U.S. Pat. No. 4,818,968, which is incorporated by reference herein, discloses a system and method for controlling the propagation of a column of light in a rare gas tube display. The system includes a plurality of rare gas tubes, each having a pair of electrodes disposed at opposite ends of the tube, wherein one of the electrodes is excited to cause a column of light to be emitted from the corresponding rare gas tube starting at a small region at one end of the tube. The excitation is changed to cause the column of light to expand to increasingly larger regions of the tube. Hence, the system creates a light sweeping effect in the rare gas tubes.

The system disclosed in the '968 patent includes appropriate control circuitry to excite the electrodes of the rare gas tubes in a manner that creates the desired light sweeping effect for a particular illumination pattern. A unique control circuit exists for each illumination pattern. Therefore, the control circuitry must be changed to adjust the illumination pattern for a particular rare gas display. The changing of the control circuit can be a time-consuming and cumbersome process.

Furthermore, rare gas tubes generally exhibit certain properties, which complicate the process of creating a predictable, linear light sweeping effect in a particular rare gas display. For example, the capacitance of a particular rare gas tube affects the expansion of a column of light through the rare gas tube. Many displays include curved rare gas tubes for aesthetic and other reasons. The curves of a rare gas tube create capacitance within the tube, which causes nonlinearities in the expansion of a column of light through the curved portions of the rare gas tube. In fact, in a typical configuration, the capacitance of the rare gas tube changes as the column of light propagates through the tube. A capacitance also exists between a rare gas tube and its surrounding environment. The environmental capacitance of a particular rare gas tube can vary widely, depending on the surroundings of the rare gas tube. The variations in capacitance caused by curves within a rare gas tube and by the surroundings of the tube make the process of creating a predictable, linear light sweeping effect in a particular rare gas display more difficult.

In addition, rare gas tubes exhibit certain undesirable properties, which are unrelated to creating a light sweeping effect within the tubes. For example, rare gas tubes typically operate at relatively high voltages, such as about 2000 volts. Therefore, rare gas displays typically use electrical transformers to step up relatively low voltage supply lines to the appropriate voltage level. Conventional transformers that provide the necessary voltage step up can be too large to place near the rare gas display itself. Accordingly, high voltage supply lines are needed for many rare gas displays to carry the high voltage signal from the transformer to the rare gas display. These high voltage supply lines can pose a safety hazard.

Moreover, an illuminated rare gas tube generates an electromagnetic field in the vicinity of the illuminated tube. This electromagnetic field undesirably creates interference, which can affect the illumination of other rare gas tubes located near the illuminated tube. Thus, the electromagnetic interference generated by illuminated rare gas tubes adds complexity and unpredictability to the illumination of rare gas displays having multiple rare gas tubes located near one another.

Additionally, rare gas tubes generally emit certain radio frequency (RF) transmissions when illuminated. These RF transmissions undesirably create interference, which can affect the operation of electronic equipment located in the vicinity of the illuminated rare gas tube. Thus, the interference caused by RF transmissions generated by illuminated rare gas tubes can impose restrictions on the decision regarding where to install a particular rare gas display.

SUMMARY OF THE INVENTION

A rare gas illumination system comprises a first rare gas tube having a first end and a second end, a first boot coupled to the first end of the first rare gas tube, and a second boot coupled to the second end of the first rare gas tube. The first boot and the second boot each comprise a housing, a transformer, and a metallic sheath configured to surround the electrode when the rare gas tube is coupled to the boot.

In one embodiment, a boot is configured to couple to a rare gas tube having an electrode. The boot comprises a housing, a transformer, and a metallic sheath configured to surround the electrode when the rare gas tube is coupled to the boot.

DETAILED DESCRIPTION OF THE PREFERRED EMBODIMENT

Figure 1:
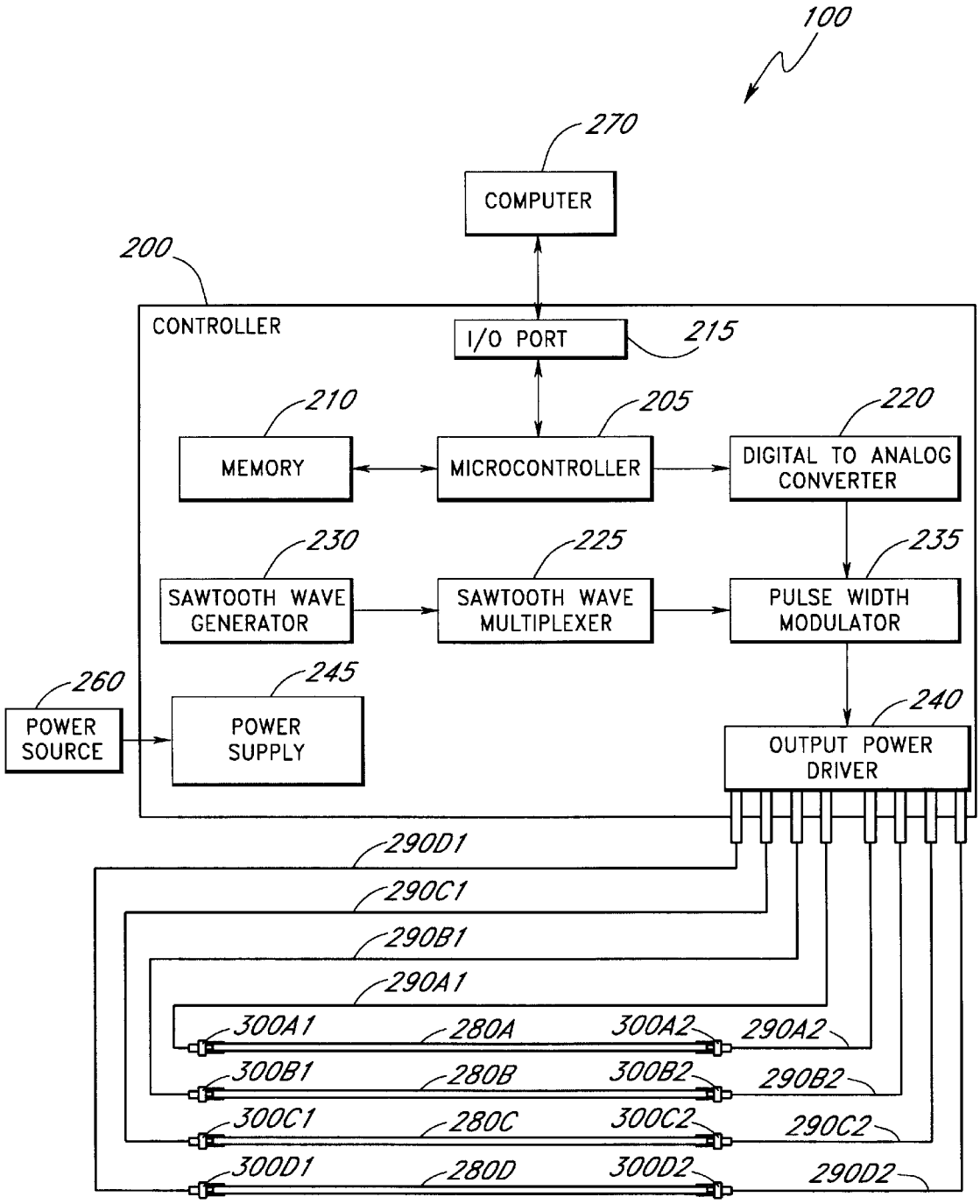
FIG. 1 illustrates a block diagram of one embodiment of the system of the present invention.

FIG. 1 illustrates a block diagram of one embodiment of the system 100 of the present invention. The system 100 of the illustrated embodiment includes a controller 200 comprising a microcontroller 205 coupled to a memory 210, an input/output (I/O) port 215, and a digital-to-analog (D/A) converter 220. The controller 200 further comprises a sawtooth wave multiplexer 225 coupled to a sawtooth wave generator 230 and to a pulse width modulator 235. The pulse width modulator 235 is also coupled to the D/A converter 220 and to an output power driver 240. The controller 200 further comprises a power supply 245.

In the illustrated embodiment, the power supply 245 of the controller 200 is coupled to a power source 260. The I/O port 215 of the controller 200 is coupled to a computer 270. The output power driver 240 of the controller 200 is coupled to a plurality of rare gas tubes 280A–D via a plurality of wires 290A1–D1, 290A2–D2 and a plurality of boots 300A1–D1, 300A2–D2. Those of ordinary skill in the art will understand that the rare gas tubes 280A–D may comprise sealed glass tubes containing a wide variety of rare gases, such as neon or argon. Furthermore, the rare gas tubes 280A–D may be straight, as shown, or the rare gas tubes 280A–D may be formed into a wide variety of shapes.

The sawtooth wave generator 230, the sawtooth wave multiplexer 225, and the pulse width modulator 235 of the controller 200 are configured to cause a column of light to be emitted from the rare gas tubes 280A–D in a manner to create a light sweeping effect. Those of ordinary skill in the art will understand that systems and methods for emitting light from rare gas tubes in a sweeping manner are well known.

In operation, the controller 200 controls the illumination of the rare gas tubes 280A–D by executing the control code for a particular illumination pattern. The memory 210 of the controller 200 is preferably configured to store the control code for a plurality of illumination patterns. Thus, by selecting one of the stored control codes, the controller 200 can vary the illumination pattern of the rare gas tubes 280A–D quickly and easily.

The computer 270 preferably comprises a personal computer that includes a processor, a memory, and standard peripherals, such as a keyboard and a display. Preferably, the computer 270 also includes software that enables a user to design various illumination patterns for the rare gas tubes 280A–D. Thus, in a preferred embodiment, the user can simulate an illumination pattern on the computer 270 and modify the pattern until the desired illumination pattern is realized. The user can then transfer the control code for the desired illumination pattern from the computer 270 to the memory 210 of the controller 200 via the I/O port 215.

In some embodiments, the rare gas tubes 280A–D may be located near one another during the display of a particular illumination pattern. Therefore, the electromagnetic field generated by an illuminated rare gas tube, such as, for example, the rare gas tube 280A, may undesirably interfere with the illumination of the other rare gas tubes 280B–D. Thus, in a preferred embodiment, the sawtooth wave multiplexer 225 of the controller 200 is configured to activate the rare gas tubes 280A–D sequentially rather than simultaneously, such that only one of the rare gas tubes 280A–D is illuminated at a time. The sequential activation of the rare gas tubes 280A–D advantageously reduces the interference caused by the electromagnetic fields generated by the rare gas tubes 280A–D when illuminated.

The time period between the sequential activation of the rare gas tubes 280A–D is preferably chosen such that each of the rare gas tubes 280A–D appears to be illuminated continuously due to the persistence of vision of the human eye. For example, the sawtooth wave multiplexer 225 may sequentially activate the rare gas tubes 280A–D during progressive time periods of about 16 microseconds each. Thus, for the system 100 illustrated in FIG. 1, the rare gas tube 280A could only be illuminated, if at all, during time periods of about 16 microseconds each separated by intervals of about 48 microseconds each, during which the rare gas tube 280A could not be illuminated. Those of ordinary skill in the art will understand that a number of other suitable time periods could be selected which also create the appearance that the rare gas tubes 280A–D are continuously illuminated due to the persistence of vision of the human eye.

The light sweeping effect in the rare gas tubes 280A–D is created by illuminating successive increments of the rare gas tubes 280A–D in sequence. Two variables determine the resolution of the light sweeping effect: (1) the length of the increments by which the rare gas tubes 280A–D are sequentially illuminated, and (2) the rate of the illumination of successive tube increments. The resolution of the light sweeping effect improves when the length of the sequentially illuminated tube increments is shortened. Similarly, the resolution of the sweeping effect improves when the illumination rate of successive tube increments is increased.

Preferably, the user controls the illumination rate of successive tube increments. For example, in a particular illumination pattern, the user may desire light to sweep through the rare gas tube 280A over a period of 30 seconds. In another illumination pattern, for example, the user may desire light to sweep through the rare gas tube 280A over a period of 1 second. If the length of the sequentially illuminated tube increments remains constant for these two illumination patterns, then the illumination rate must increase dramatically in the second illumination pattern to accomplish the desired light sweeping effect in the allotted time. Hence, the resolution of the light sweeping effect in the second illumination pattern is better than the resolution in the first illumination pattern, because the amount of time spent at each tube increment in the first pattern creates a step-like visual effect. Thus, for a lower illumination rate (e.g., 30 seconds for the tube length), smaller tube increments may be desirable to create a smoother visual effect.

On the other hand, the human eye cannot perceive the sequential illumination of successive tube increments above a certain illumination rate. Thus, once the illumination rate of successive tube increments reaches a certain value, then increasing the illumination rate does not result in improved resolution of the light sweeping effect. Accordingly, in a preferred embodiment, the controller 200 can compute a tube increment length and an illumination rate that will optimize the perceptible resolution of the desired light sweeping effect in a particular illumination pattern.

In a preferred embodiment, the memory 210 of the controller 200 includes a automatic calibration routine that determines the lowest voltage value required to begin illuminating the rare gas tubes 280A–D. This value is referred to herein as a "minimum" voltage value. The controller 200 also determines the lowest voltage value required to fully illuminate the rare gas tubes 280A–D. This value is referred to herein as a "maximum" voltage value, although it should be understood that it is not necessarily the largest voltage value that could be applied to the rare gas tubes 280A–D.

The difference between these minimum and maximum voltage values represents the "electrical length" of the rare gas tubes 280A–D. The electrical length of the rare gas tubes 280A–D may be affected by a variety of parameters, such as, for example, physical length, diameter, gas, color, shape or mounting location of the rare gas tubes 280A–D. The controller 200 may refer to the electrical length of the rare gas tubes 280A–D when computing the optimum tube increment length for a particular illumination pattern, as described above.

Figure 2A:
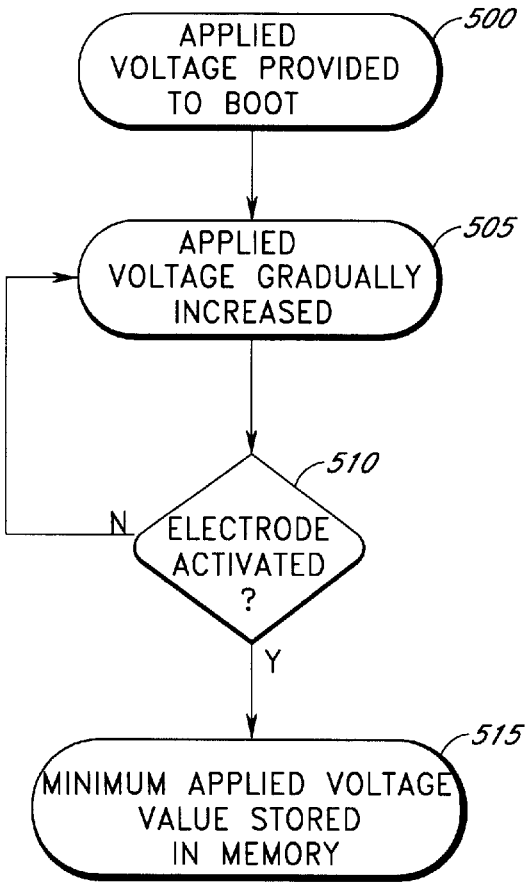
FIGS. 2A–2B illustrate the operation of the controller during the automatic calibration routine.

FIG. 2A illustrates a flow chart showing the operation of the controller 200 when determining the voltage required to begin illuminating the rare gas tube 280A from a first end during the automatic calibration routine. In a first step 500, the controller 200 begins to provide an applied voltage to a first boot 300A1 through the wire 290A1. In a next step 505, the controller 200 gradually increases the applied voltage provided to the first boot 300A1.

In a further step 510, the controller 200 senses whether the first boot 300A1 is providing sufficient voltage to a first electrode at the first end of the rare gas tube 280A to activate the first electrode. The controller 200 detects the activation of the first electrode by sensing a change in the voltage applied to the first electrode caused by increased current flow. If the controller does not sense a change in the voltage applied to the first electrode, then the controller 200 determines that the first electrode has not been activated. Processing then returns to the step 505, where the controller 200 continues to gradually increase the applied voltage provided to the first boot 300A1. Once the applied voltage reaches a sufficient level to activate the first electrode, the controller 200 senses a change in the voltage applied to the first electrode caused by increased current flow. In a step 515, the controller 200 stores the activation voltage level as the minimum voltage value for the first boot 300A1 in the memory 210.

Figure 2B:
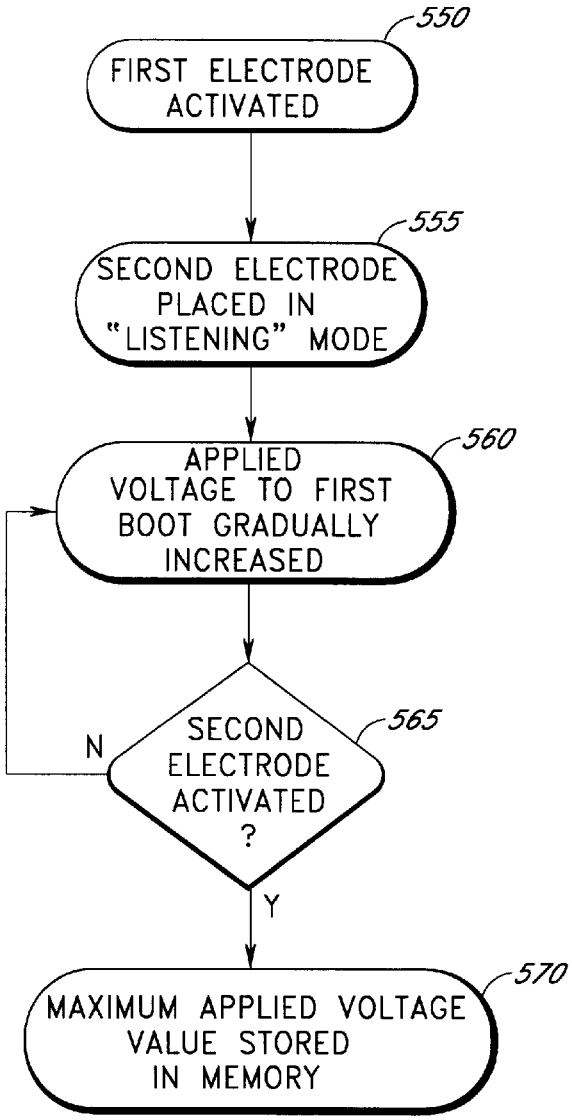

FIG. 2B illustrates a flow chart showing the operation of the controller 200 when determining the voltage required to fully illuminate the rare gas tube 280A from the first end during the automatic calibration routine. In a step 550, the controller 200 provides an applied voltage to the first boot 300A1. In another step 555, the controller 200 places a corresponding second boot 300A2 on a second end of the rare gas tube 280A in a "listening" mode. That is, the controller 200 uses the second boot 300A2 to monitor the voltage at a second electrode at the second end of the rare gas tube 280A. The voltage at the second electrode will increase when the gas is excited throughout the entire length of the tube 280A to provide a conductive path from the first electrode to the second electrode. In a next step 560, the controller 200 gradually increases the applied voltage provided to the boot 300A1 on the first end, thus propagating a column of light from the first end toward the second end of the rare gas tube 280A.

In a further step 565, the controller 200 determines whether the rare gas tube 280A is fully illuminated by sensing whether the voltage on the second electrode has increased to indicate that the gas in the entire length of the rare gas tube 280A is excited. When the column of light reaches the second end of the rare gas tube 280A, the voltage on the second electrode increases, and the increased voltage on the second electrode can be detected. If the controller does not sense an increased voltage on the second electrode, then the controller 200 determines that the second electrode has not been activated, and the rare gas tube 280A is therefore not fully illuminated. Processing then returns to the step 560, where the controller 200 continues to gradually increase the applied voltage provided to the first boot 300A1. Once the applied voltage provided to the first boot 300A1 on the first end of the rare gas tube 280A is sufficient to fully illuminate the rare gas tube 280A, the controller 200 detects the increased voltage on the second electrode. The controller 200, in a step 570, stores the applied voltage level provided to the first boot 300A1 as the maximum voltage value for the first boot 300A1 in the memory 210.

This process is repeated to determine the "minimum" voltage required to activate the second boot 300A2 on the second end of the rare gas tube 280A and to determine the "maximum" voltage required to fully illuminate the rare gas tube 280A from the second end. Furthermore, the process can be repeated to determine the respective voltages required to activate the other boots 300B1–D1, 300B2–D2 and to determine the respective voltages required to fully illuminate the other rare gas tubes 280B–D from each end.

In one embodiment, the controller 200 stores the minimum and maximum voltage values determined during the automatic calibration routine in the memory 210 in units corresponding to the digital input of the D/A converter 220, or "DAC counts." For example, the voltage required to activate the boot 300A1 may correspond to 30 DAC counts, and the voltage required to fully illuminate the rare gas tube 280A from the first end may correspond to 190 DAC counts. The difference between the minimum and maximum voltage values for the boot 300A1 (160 DAC counts in this example) represents the "electrical length" of the rare gas tube 280A. The controller 200 may refer to the electrical length of the rare gas tube 280A when computing the physical length of a tube increment and an illumination rate that will optimize the perceptible resolution of the desired light sweeping effect in a particular illumination pattern, as discussed above.

In one embodiment, the controller 200 comprises a second D/A converter (not shown), which can be used to further improve the resolution of the light sweeping effect. The controller 200 can vary the incremental analog output corresponding to an incremental digital input of the second D/A converter based on the electrical length of the rare gas tube 280A. For example, if 256 unique digital inputs into the second D/A converter are possible, then the controller 200 can subdivide the electrical length of the rare gas tube 280A into 256 increments rather than 160 increments, as in the above example. Thus, the physical length of the minimum possible tube increment is shortened, and the resolution of the light sweeping effect in a particular illumination pattern may be improved.

Figure 3:
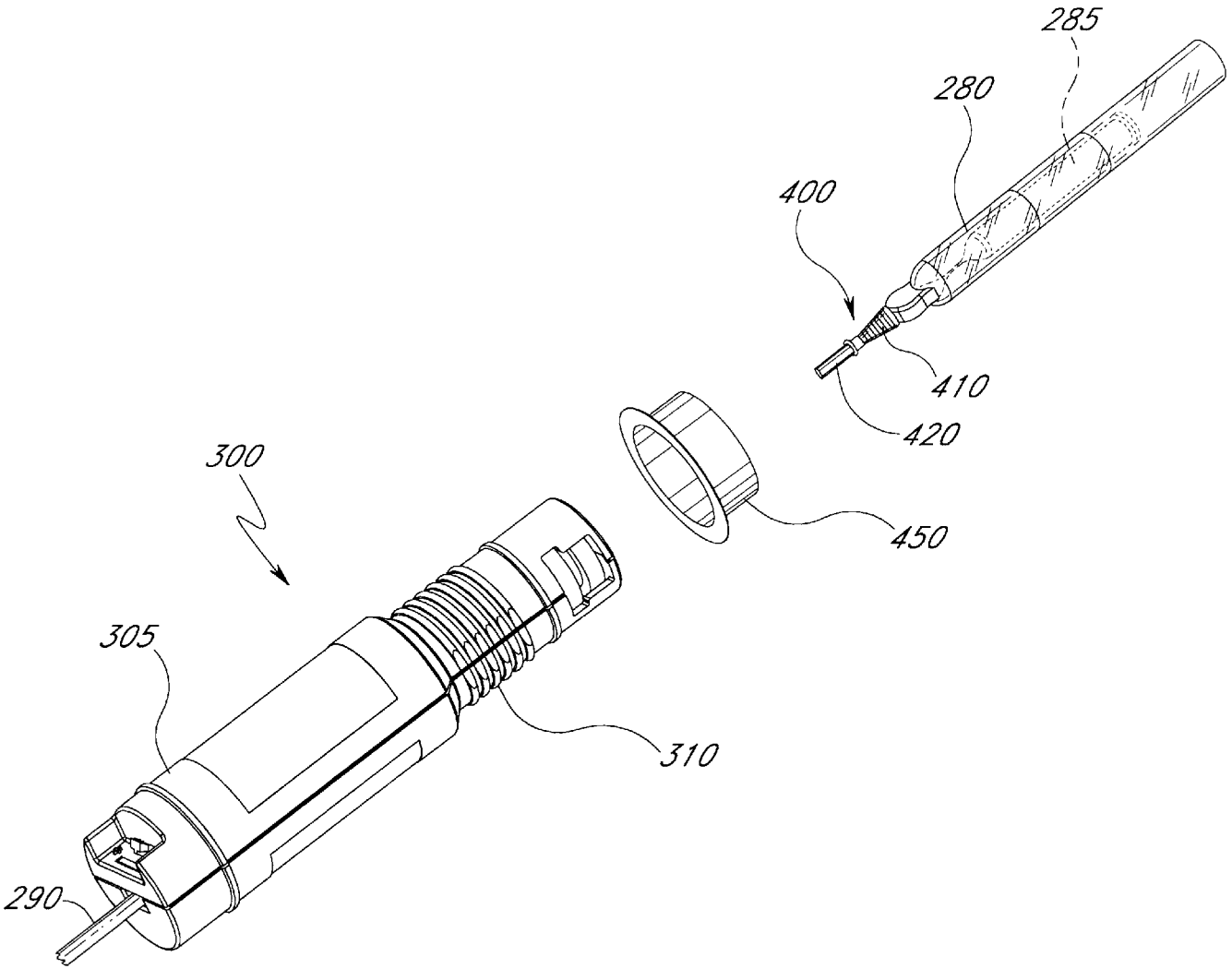
FIG. 3 illustrates one embodiment of a tube connector and a boot in accordance with the present invention.

FIG. 3 illustrates one embodiment of a rare gas tube 280, a tube connector 400, and a boot 300 in accordance with the present invention. As illustrated in FIG. 3, the rare gas tube 280 includes an electrode 285, which, as described above, excites the gas within the tube to cause the rare gas tube 280 to illuminate. The tube connector 400 is preferably configured to couple with a conventional rare gas tube 280 and with the boot 300. The tube connector 400 comprises a spring 410 and a tab 420. The spring 410 advantageously protects the end of the rare gas tube 280 and adds flexibility to the connector 400. In a preferred embodiment, the spring 410 and the tab 420 comprise a noncorrosive conductive material, such as nickel (Ni). Those of ordinary skill in the art will understand that the spring 410 and the tab 420 may comprise a wide variety of other suitable conductive materials.

The boot 300 of the illustrated embodiment comprises a housing 305, which advantageously covers and protects the components of the boot 300. In a preferred embodiment, the boot 300 comprises a rigid nonconductive thermoplastic material. The housing 305 can be separated to expose the components of the boot 300. The housing 305 includes threads 310, which are configured to engage a ring 450 to keep the housing 305 closed while the boot 300 is in use. In a preferred embodiment, the housing 305 is configured to provide a weather-tight seal around the components of the boot 300 when closed.

Figure 4:
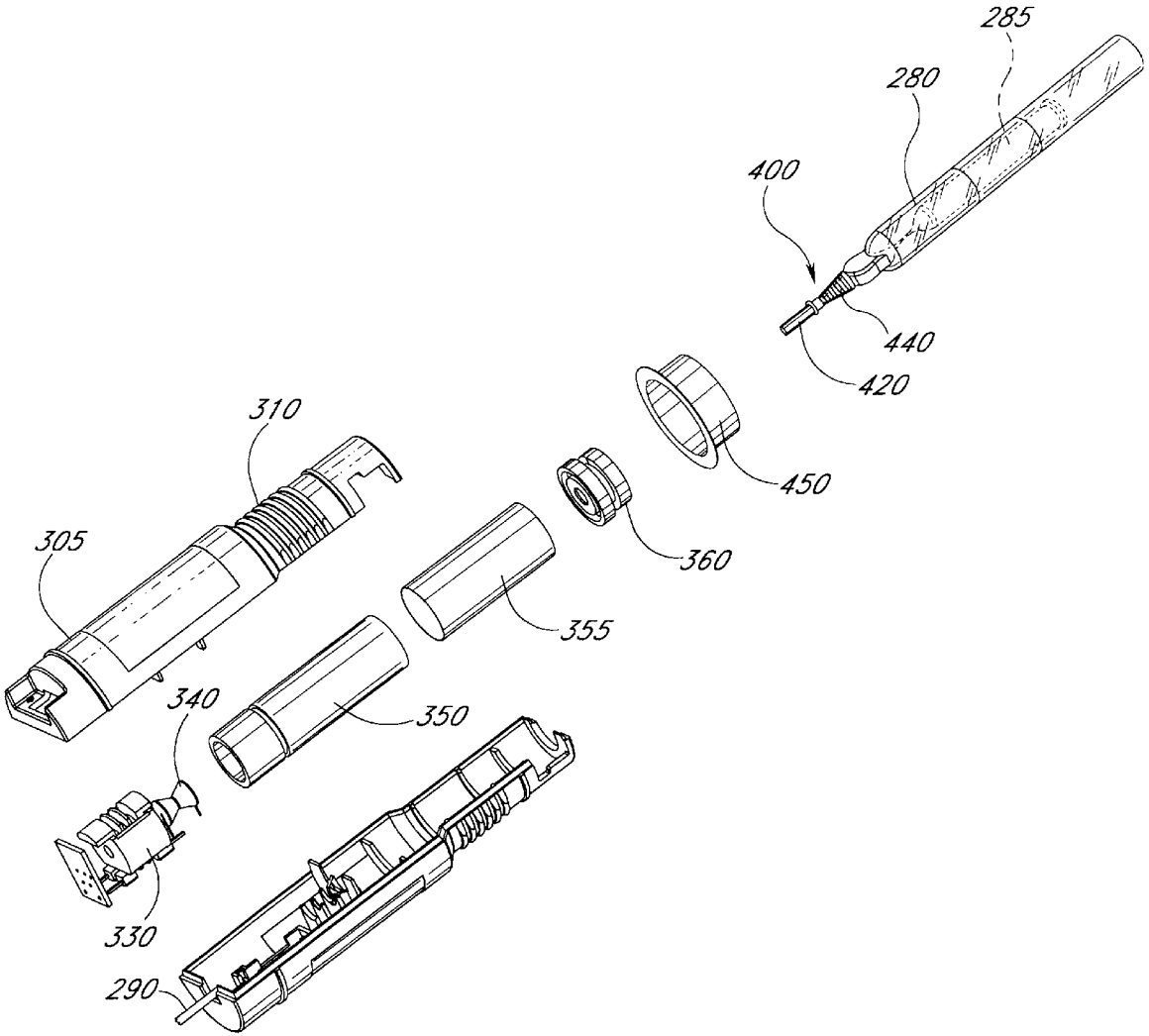
FIG. 4 illustrates an exploded view of one embodiment of a boot in accordance with the present invention.

FIG. 4 illustrates an exploded view of one embodiment of a boot 300 in accordance with the present invention. In the illustrated embodiment, the boot 300 comprises a transformer 330, a spring 340, a cylinder 350, and a washer 360. The transformer 330 is coupled to the spring 340 and is configured to electrically couple to one of the wires 290 from the controller 200, as shown in FIG. 1.

In a preferred embodiment, the transformer 330 is a modified pot-core style transformer (i.e., the transformer 330 preferably comprises a ferrite core located on the outside of a plurality of coiled wires), which occupies a volume of about 1 cubic inch. Furthermore, the transformer preferably has a 100:1 secondary to primary turns ratio (i.e., the transformer 330 is preferably configured to step up the input voltage by a factor of 100). This transformer size and configuration advantageously allow the transformer 330 to be located near the rare gas tube 280 itself, thereby reducing the need for the wire 290 to carry a high voltage signal. In a preferred embodiment, the wire 290 carries a relatively low voltage signal. For example, the "maximum" voltage is advantageously in the range of about 19 volts to about 29 volts, more preferably in the range of about 22 volts to about 27 volts, and still more preferably a voltage of about 24 volts. In this example, the output of the transformer 330 preferably has a voltage in the range of about 1900 volts to about 2900 volts, more preferably in the range of about 2200 volts to about 2700 volts, and still more preferably a voltage of about 2400 volts. By allowing the wire 290 to carry a relatively low voltage signal, the transformer 330 improves the safety of the system 100. Of course, it should be understood that the low voltage input and, hence, the high voltage output of the transformer 330 is varied from the "maximum" voltage to a lower voltage to vary the length of a column of light within the rare gas tube 280.

The luminance of the rare gas tube 280 is proportional to the excitation frequency of the electrode 285. The input signal applied to the transformer 330 preferably comprises a square wave oscillating at a frequency in the range of about 32 kilohertz (kHz) to about 56 kHz, more preferably in the range of about 34 kHz to about 46 kHz, and still more preferably at a frequency of about 36 kHz. In a preferred embodiment, the transformer 330 is configured to generate harmonic output frequencies in the range of 1 to 4 times the input frequency, thereby advantageously increasing the brightness of the light within the rare gas tube 280. For example, if the input signal applied to the transformer 330 has a frequency of 36 kHz, then the output of the transformer 330 preferably comprises a signal having a frequency in the range of about 36 kHz to about 144 kHz, more preferably having a frequency of about 108 kHz. Those of ordinary skill in the art will understand that the harmonic output frequencies of the transformer 330 can be adjusted by adjusting various parameters, such as, for example, the inductance and the capacitance of the transformer 330.

The spring 340 is coupled to the transformer 330 and is configured to electrically couple to the tab 420 of the tube connector 400. The spring 340 advantageously provides flexibility to the electrical connection between the tube connector 400 and the transformer 330.

In a preferred embodiment, the cylinder 350 comprises a rigid nonconductive thermoplastic material. The cylinder 350 is configured to be covered with a sheath 355, which preferably comprises a conductive material, such as, for example, copper (Cu), aluminum (Al), or any ferrous metal, such as steel, bronze, brass, and the like. Those of ordinary skill in the art will understand that the sheath 355 may comprise a wide variety of other suitable conductive materials. The cylinder 350 and the sheath 355 are configured to surround the electrode 285 of the rare gas tube 280 when the rare gas tube 280 is inserted in the boot 300.

The sheath 355 of the cylinder 350 promotes higher current flow from the output of the transformer 330 by adding a capacitively loaded return to ground, which in turn raises the electron acceleration potential of the gas within the rare gas tube 280. Thus, by increasing the capacitance of the rare gas tube 280, the sheath 355 advantageously increases the brightness of the light within the rare gas tube 280.

Furthermore, in various embodiments, the capacitance of the rare gas tube 280 can vary widely, depending on factors such as the shape and the environment of the rare gas tube 280. Thus, the sheath 355 preferably creates a predictable capacitive load near the electrode 285 that dominates any unpredictable capacitances that may exist for a particular rare gas tube 280 configuration. By creating a predictable capacitive load, the sheath 355 advantageously allows the output of the transformer 330 to be designed to match the predicted impedance of the rare gas tube 280, thereby improving the efficiency of the transfer of power from the wire 290 to the rare gas tube 280.

Moreover, when the rare gas tube 280 is illuminated, the electrode 285 of the rare gas tube 280 undesirably emits radio frequency (RF) transmissions, which can interfere with the operation of electronic equipment in the vicinity of the rare gas tube 280. Therefore, the sheath 355 of the cylinder 350 shields the electrode 285 of the rare gas tube 280 and advantageously contains the RF transmissions generated by the electrode 285 of the rare gas tube 280. Thus, the sheath 355 reduces the RF transmissions emitted by the rare gas tube 280, and provides greater flexibility in deciding where to install the display including the rare gas tube 280.

The washer 360 preferably comprises a flexible nonconductive thermoplastic material. Therefore, the washer 360 advantageously provides additional insulation between the rare gas tube 280 and the surrounding environment. Furthermore, the washer 360 is preferably configured to secure the rare gas tube 280 in place when the tube connector 400 is electrically coupled to the transformer 330. Thus, the washer 360 advantageously strengthens the connection between the rare gas tube 280 and the boot 300.

When the parts shown in FIG. 4 are interconnected and enclosed, as shown in FIG. 3, the tab 420 of the tube connector 400 is inserted into the boot 300. A like connection is made at the opposite end of the rare gas tube 280. The rare gas tube 280 is then activated by applying a selected voltage at a selected sweep rate to at least one of the boots 300 at at least one end of the rare gas tube 280 to illuminate the gas in the rare gas tube 280.

Although the foregoing has been a description and illustration of specific embodiments of the invention, various modifications and changes can be made-thereto by persons skilled in the art, without departing from the scope and spirit of the invention as defined by the following claims.

What is claimed is:

1. A rare gas illumination system, comprising:

a first rare gas tube having a first electrode at a first end and a second electrode at a second end;

a first boot coupled to said first end of said first rare gas tube; and a second boot coupled to said second end of said first rare gas tube, said first boot and said second boot each comprising:

a housing configured to be removably coupled to said first end or said second end of said first rare gas tube, a transformer, and a metallic sheath configured to surround said first electrode or said second electrode when said rare gas tube is coupled to said boot.

2. A boot configured to couple to a rare gas tube having an electrode, said boot comprising:

a housing configured to be removably coupled to an end of a rare gas tube having an electrode;

a transformer; and a metallic sheath configured to surround said electrode when said rare gas tube is coupled to said boot.

3. The boot of claim 2, wherein said housing is configured to provide a weather-tight seal around said transformer and said metallic sheath.

4. The boot of claim 2, wherein said metallic sheath comprises copper, aluminum, steel, bronze, or brass.

5. The boot of claim 2, wherein said metallic sheath is configured to create a capacitance when said electrode is excited.

6. The boot of claim 5, wherein said capacitance comprises a predictable capacitive load that dominates a variable capacitance of said rare gas tube.

7. The boot of claim 6, wherein an output of said transformer is designed to match said predictable capacitive load.

8. The boot of claim 2, wherein said metallic sheath is configured to shield a radio frequency transmission emitted by said electrode.

9. The boot of claim 2, further comprising a washer, wherein said washer is configured to strengthen a connection between said boot and said rare gas tube.

* * * * *